US008024863B2

(12) United States Patent
Wain

(10) Patent No.: US 8,024,863 B2
(45) Date of Patent: Sep. 27, 2011

(54) CONFORMING WET SHAVING RAZOR

(75) Inventor: Kevin James Wain, Reading (GB)

(73) Assignee: The Gillette Company, Boston, MA (US)

( * ) Notice: Subject to any disclaimer, the term of this patent is extended or adjusted under 35 U.S.C. 154(b) by 442 days.

(21) Appl. No.: 12/260,384

(22) Filed: Oct. 29, 2008

(65) Prior Publication Data

US 2010/0101092 A1 Apr. 29, 2010

Related U.S. Application Data

(60) Provisional application No. 61/001,617, filed on Nov. 2, 2007.

(51) Int. Cl.
*B26B 21/02* (2006.01)

(52) U.S. Cl. ..... 30/57; 30/50; 30/527

(58) Field of Classification Search ..... 30/50, 57, 30/527

See application file for complete search history.

(56) References Cited

U.S. PATENT DOCUMENTS

| | | | | |
|---|---|---|---|---|
| 3,816,913 | A | 6/1974 | Ferraro | |
| 4,227,302 | A | 10/1980 | Torrance | |
| 4,253,236 | A | 3/1981 | Jacobson | |
| 5,104,605 | A | 4/1992 | Butlin et al. | |
| 5,182,858 | A | 2/1993 | Chen | |
| 5,236,439 | A | 8/1993 | Kosikowski | |
| 5,388,332 | A | 2/1995 | Olroyd | |
| 5,822,862 | A | 10/1998 | Ferraro | |
| 5,953,825 | A * | 9/1999 | Christman et al. | 30/527 |
| 6,115,924 | A | 9/2000 | Olroyd | |
| 6,173,498 | B1 | 1/2001 | Warrick et al. | |
| 6,804,886 | B2 * | 10/2004 | Wain | 30/50 |
| 7,024,776 | B2 | 4/2006 | Wain | |
| 7,047,646 | B2 | 5/2006 | Coffin | |
| 7,131,203 | B2 * | 11/2006 | Wain | 30/57 |
| 7,200,938 | B2 | 4/2007 | Lembke | |
| 2002/0023352 | A1 | 2/2002 | Mil'shtein | |
| 2003/0208907 | A1 | 11/2003 | Brown et al. | |
| 2005/0015991 | A1 | 1/2005 | Follo et al. | |
| 2006/0218794 | A1 | 10/2006 | Bunnell et al. | |
| 2007/0056167 | A1 | 3/2007 | Richard et al. | |
| 2010/0229397 | A1 * | 9/2010 | Nakasuka | 30/50 |

* cited by examiner

*Primary Examiner* — Stephen Choi
(74) *Attorney, Agent, or Firm* — Austin P. Wang; Kevin C. Johnson; Steven C. Miller

(57) ABSTRACT

A wet shaving razor comprising a cartridge having a length wherein the cartridge comprises an upper frame comprising 1) a blade frame, 2) a shaving blade joined to the blade frame where the blade extends lengthwise along the cartridge, 3) an upper face that surrounds the blade, and 4) one or more serially arranged rear spring elements, each element having a proximate and distal end such that said proximate end is joined adjacent a top edge of the upper face and wherein said distal end is joined to a catch plate; a sub-frame upon which said upper frame is resiliently mounted at its bottom edge near a front edge of said sub-frame wherein said sub-frame further comprises front spring elements; and a catch plate that causes the rear spring elements to foldably engage with a rear edge of said sub-frame to provide removably secured rear spring elements; and wherein the front spring elements and rear spring elements oppose local deformation of the cartridge under shaving forces encountered during shaving.

15 Claims, 4 Drawing Sheets

CONFORMING WET SHAVING RAZOR

CROSS REFERENCE TO RELATED APPLICATIONS

This application claims the benefit of U.S. Provisional Application No. 61/001,617 filed Nov. 2, 2007.

FIELD OF THE INVENTION

The present invention relates to a razor suitable for use for wet shaving wherein the razor comprises a conforming cartridge that includes rear spring elements that foldably engage with the remainder of the cartridge.

BACKGROUND OF THE INVENTION

This invention relates to a wet shaving razor comprising a cartridge and an adjoining handle and includes a shaving blade with a cutting edge which is moved across the surface of the skin being shaved by means of the handle. A cartridge may be mounted detachably on a razor handle to enable the cartridge to be replaced by a fresh cartridge when the blade sharpness has diminished to an unsatisfactory level, or it may be fixedly attached to the handle with the intention that the entire razor be discarded when the blade or blades have become dulled. Detachable and replaceable cartridges are commonly referred to as shaving cartridges.

There have been various proposals for mounting a cartridge on a handle to enable movement of the cartridge during shaving with the aim of maintaining conformity of the skin contacting parts with the skin surface during shaving. For example, many razors currently marketed have cartridges which are pivotable about longitudinal axes extending parallel to the cutting edges of the elongate blades incorporated in the cartridges. Additionally, the Applicant has realized the utility of providing consumers with a conforming razor cartridge as disclosed in U.S. Pat. Nos. 7,024,776B2 and 7,131,203B2. The conforming razor cartridges disclosed in these two patents were injection molded and the blade unit was attached after molding by forcing metal anchors on a blade support of the blade unit through holes in the elastomeric cartridge. It was typical, however, with this configuration that the thin metal of the blade unit acted in a similar way to a knife blade and would cut the rubber or elastomer material that formed the cartridge if the hole for receiving the blade unit was not held open by a blunt, stretching device which itself required the hole to be stretched to allow for insertion of the blade unit. To accommodate for this manipulation, the patentee realized that it was ideal to employ an elastomeric material or rubber capable of relatively high elongation. Such highly elongatable and/or extensible materials typically exhibit high tear resistance as well but are usually relatively expensive. Another not so positive aspect of this previously disclosed conforming razor was the fact that the anchors and holes mentioned for blade unit insertion often detract from the comfort of the shave experienced by consumers.

Based on this previous development and others, there is still a need for a conforming razor product that overcomes these difficulties experienced during manufacturing as well as during shaving.

SUMMARY OF THE INVENTION

The present invention relates to a wet shaving razor comprising a cartridge having a length wherein the cartridge comprises:

a) an upper frame comprising
   1) a blade frame;
   2) a shaving blade joined to said blade frame where said blade extends lengthwise along said cartridge;
   3) an upper face that surrounds said blade frame; and
   4) one or more serially arranged rear spring elements, each element having a proximate and distal end such that said proximate end is joined adjacent a top edge of said upper face and wherein said distal end is joined to a catch plate;

b) a sub-frame upon which said upper frame is resiliently mounted at its bottom edge near a front edge of said sub-frame wherein said sub-frame further comprises front spring elements; and c) a catch plate that causes the rear spring elements to foldably engage with a rear edge of said sub-frame to provide removably secured rear spring elements; and wherein the front spring elements and rear spring elements oppose local deformation of the cartridge under shaving forces encountered during shaving.

In certain embodiments, several rear spring elements are distributed along the top edge of the upper face, and each rear spring element is deformable in such a manner so that it exerts a substantially constant restoring force irrespective of the degree of deformation.

In such embodiments, the deformation of the cartridge under shaving forces can vary along the length of the cartridge enabling the cartridge to conform to skin undulations along the cartridge, with the forces exerted by the cartridge against the skin being substantially uniform along the cartridge. As a result, close conformity between the cartridge and the skin contours can be achieved without causing discomfort due to the cartridge being pressed against the skin under higher forces in certain confined areas. This easily achieved conformation of the cartridge may be attributable to the rear spring elements comprising a sheet of resiliently flexible material.

In one embodiment, the cartridge comprises an upper frame on which the shaving blade is carried, and a sub-frame, with rear spring elements being interposed between the upper frame and the sub-frame. Conveniently, the cartridge is formed by a unitary molding of a resiliently flexible material, such as rubber or rubber-like material, the rear spring elements then being integral with the upper frame (particularly the upper face) and joined at a rear edge of the sub-frame via a catch plate. With the cartridge formed as a unitary mold piece, manufacture of the cartridge is facilitated as assembly of components is minimized. The upper frame is preferably hinged to the sub-frame at the front of the cartridge, and, with a molded construction, the connection between them may be conveniently provided by a living hinge. The hinged connection between the upper frame and the sub-frame is displaceable downwardly, generally towards a handle, under load forces exerted at a front portion of the upper frame. The sub-frame may be supported with respect to an underlying base in a manner permitting movement of the sub-frame towards the base against the action of front spring elements which can also be formed by sheets of resiliently flexible material which deform by buckling so that a substantially constant return force is exerted on the sub-frame.

A portion of the upper frame may form a guard for contacting the skin ahead of the shaving blades during a shaving stroke, and a cap for contact with the skin behind the blades. Alternatively, a separate guard element and/or a separate cap element could be mounted on the upper frame, although any such separate element would need to exhibit substantial flexibility along its length, or perhaps be divided up into short segments so as not to inhibit the flexing of upper frame to conform to the skin contours. One type of element suitable for mounting or incorporation into the guard surface or cap surface is a lubricating strip.

Although the cartridges of the invention may have a single shaving blade, a plurality of blades, e.g. 2, 3, 4, 5, 6, 7, 8, or even more blades, may be included and extend continuously along the cartridge with their sharpened edges substantially parallel. These blades are flexible for conforming to the skin contours. Another possibility is for several blade segments to be disposed along the cartridge so that they are able to move relative to each other as the upper frame flexes. To facilitate assembly of the cartridge the blade(s) may be interconnected by transverse strips attached to the undersides of the blades, these strips and the blades together forming a flexible blade assembly in which, in an undeformed condition, the blades and strips are substantially coplanar to enhance the flexibility of the blade frame. Alternatively, the blades may be securedly mounted atop blade supports where the sharpened cutting edges are bent forward away from the plane of the blade frame to provide non-coplanar approach angle for the blades against the hair.

The details of one or more embodiments of the invention are set forth in the accompanying drawings and the description below. Other features, objects, and advantages of the invention will be apparent from the description and drawings, and from the claims.

DETAILED DESCRIPTION OF THE INVENTION

Figure 1:
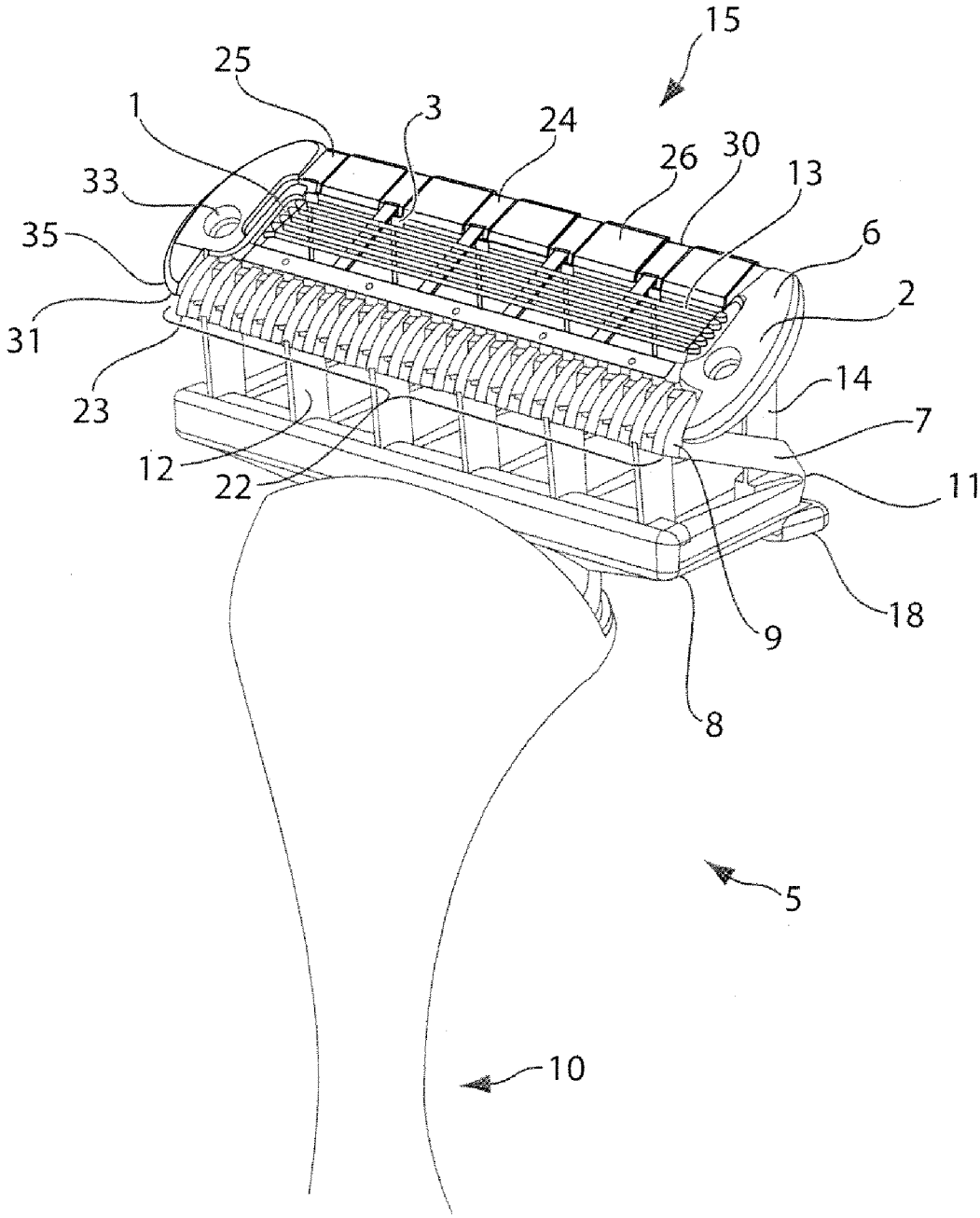
FIG. 1 shows a front perspective view of a wet shaving razor equipped with a conforming cartridge in accordance with the invention.
Figure 2:
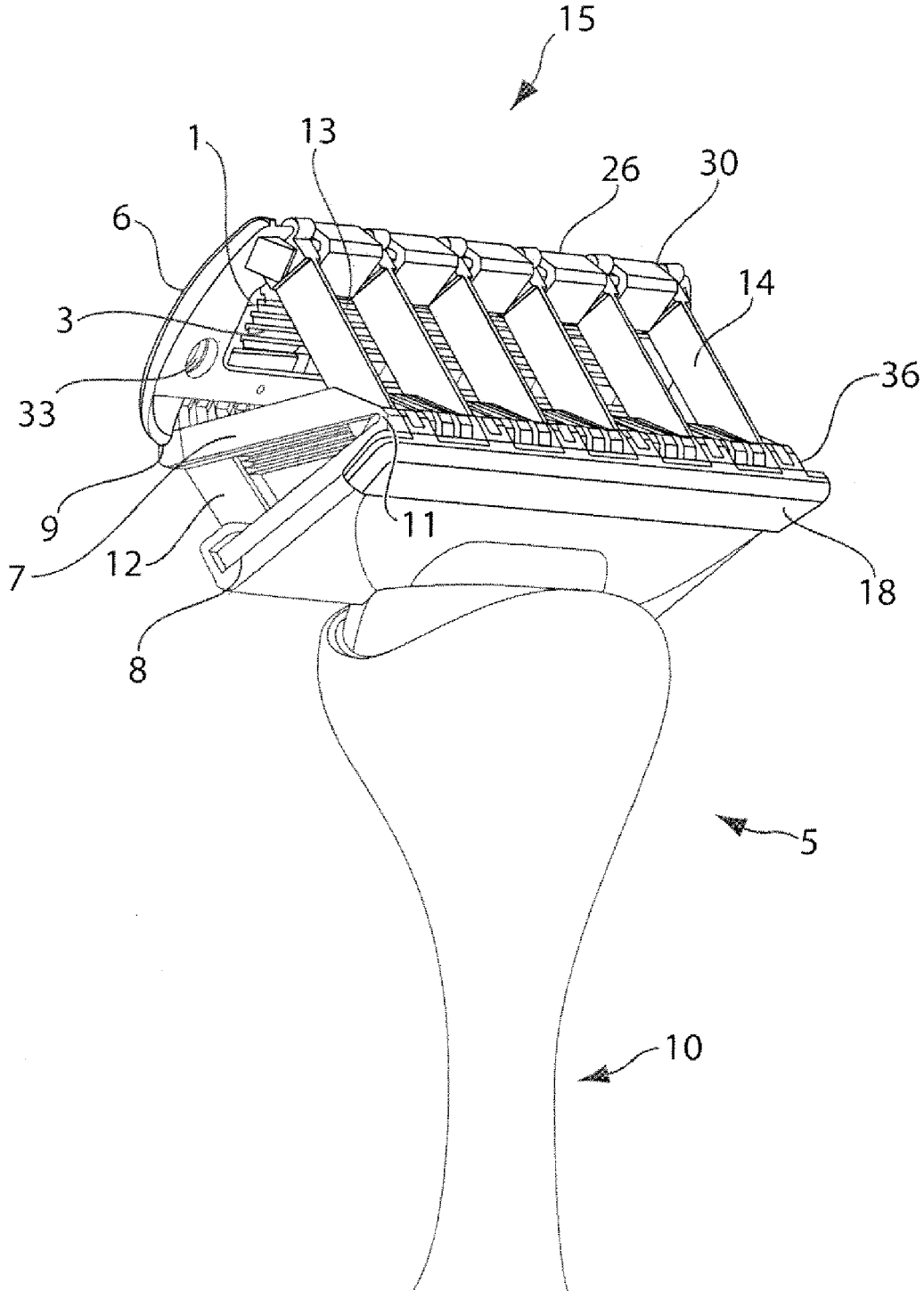
FIG. 2 is a rear perspective view of the razor of FIG. 1.

The wet shaving razor 5 in FIGS. 1 and 2 has a handle 10 on which a conforming cartridge 15 is mounted. As shown, the handle 10 has joined to it a base 8 to which the cartridge 15 may be fastened, but the cartridge could also be releasably connected to the handle 10 to allow replacement of the cartridge 15. The cartridge 15 comprises an upper frame 6 and a sub-frame 7 joined at a front edge of the cartridge 15. The upper frame 6 comprises a blade frame 1 that comprises a shaving blade 3 wherein the blade frame 1 may be incorporated by clipped in insertion or via insert molding with the latter being advantageous. In the illustrated embodiment, the cartridge 15 consists of a unitary molding of rubber or a material having similar resiliently flexible properties to materials having appropriate characteristics include BASF's Elastollan C60A10W.

Figure 4:
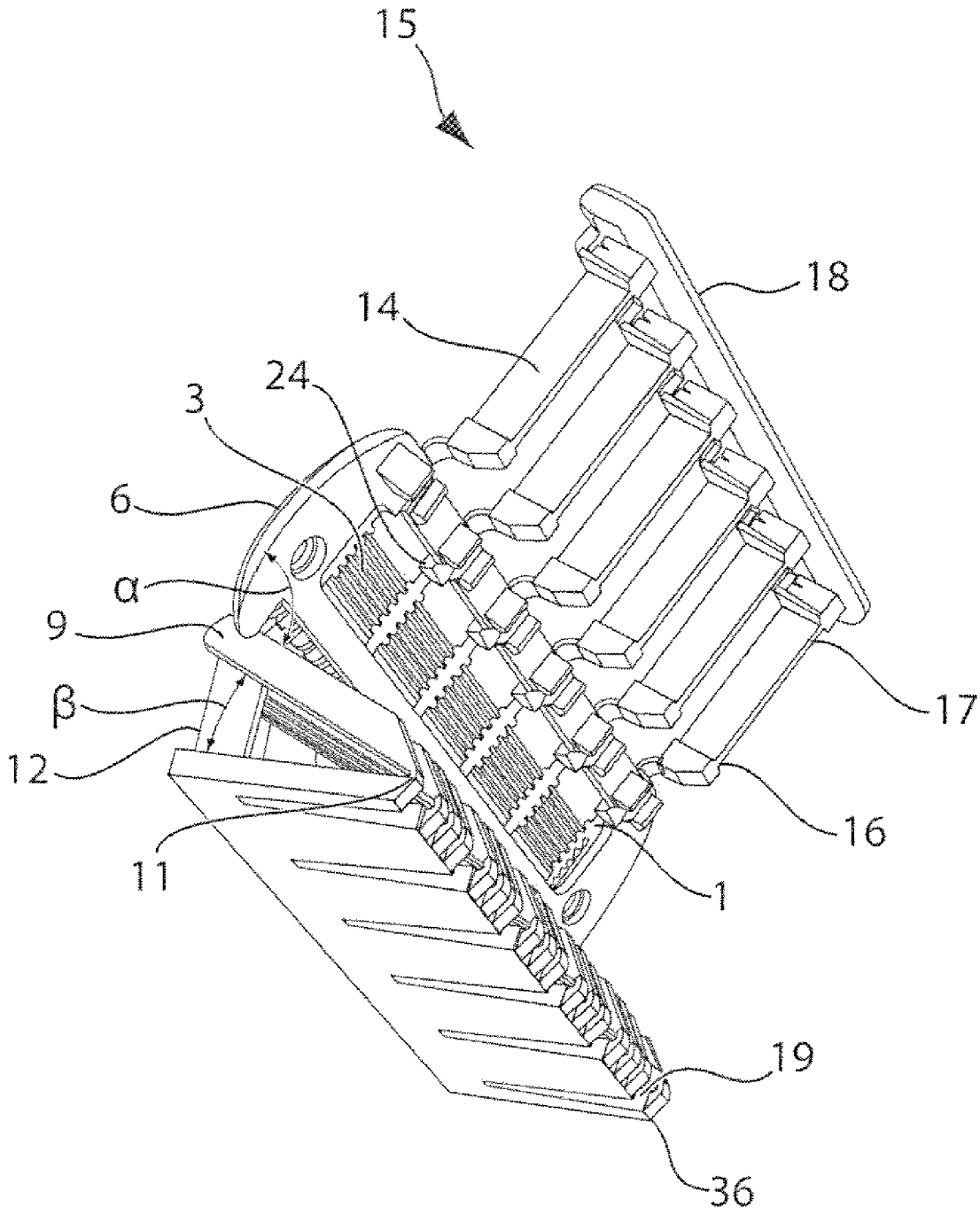
FIG. 4 is a right end elevational view of the cartridge of FIG. 3.

The cartridge 15 comprises an upper frame 6 having an upper face 2 (having a top edge 30 and a bottom edge 31, which actually corresponds and coincides with the front edge 35 of the cartridge) surrounding the blade frame 1 (which includes a shaving blade 3), a sub-frame 7 which has the form of a plurality of rectangular beams joined together by living hinges, and a base 8. The upper frame 6 is hingedly connected to the sub-frame 7 at the bottom edge of the upper face 2 and at front edge 35 of the sub-frame 7. In particular, the upper frame 6 and sub-frame 7 are integral and are connected by a living hinge 9 at their forward edges. The upper frame 6 and the sub-frame 7 lie in first and second planes respectively, and are relatively positioned normally to diverge from each other rearwardly away from the hinge 9. The sub-frame 7 and the base 8 are hingedly connected at the rear of the cartridge, and more especially the sub-frame 7 and base 8 are integrally connected by a living hinge 11 at a rear (or back) 36 edge of the sub-frame. The sub-frame 7 and base 8 are normally disposed to diverge from each other in the direction forwardly away from the hinge 11. With this configuration, the upper frame 6, sub-frame 7 and base 8, as viewed in right end elevation (FIG. 4), define a Z shape, but with the angle $\alpha$ disposed between the upper frame 6 and the sub-frame 7 being greater than the angle $\beta$ subtended between the sub-frame 7 and the base 8 so that the upper frame 6 is normally set at an appropriate angle with respect to the handle 10 and to ensure the desired deformation characteristics of the cartridge 15 as explained below.

Figure 3:
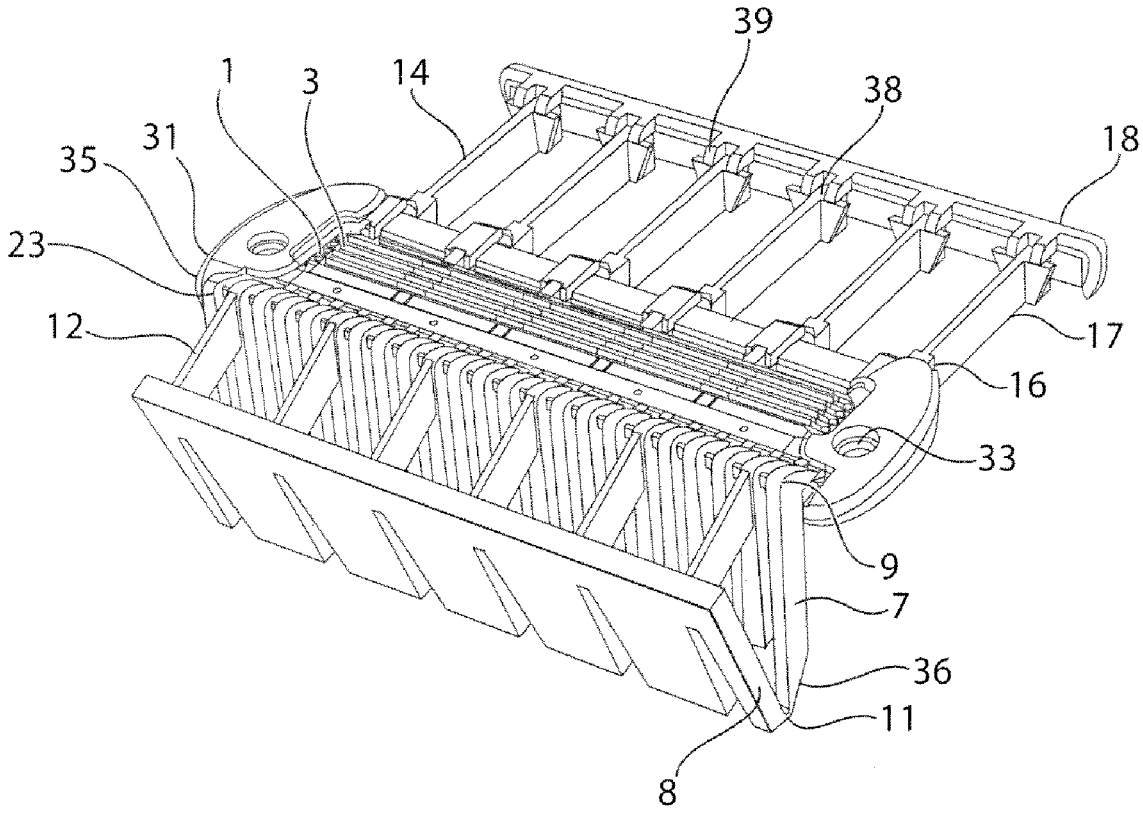
FIG. 3 is a front elevational view of cartridge of the present invention prior to final engagement of a plurality of rear spring elements with the sub-frame.

The sub-frame 7 is supported with respect to the base 8 by one or more (in the case shown in FIGS. 1 and 2 there are several) rear spring elements 14 serially arranged along a rear length of the upper face of the cartridge 15. These rear spring elements 14 are formed by resiliently flexible webs integral with the upper frame. Each of the rear spring elements 14 has a proximate end 16 and a distal end 17 where the proximate end 16 is joined adjacent a top edge 30 of the upper face and where the distal end 17 is joined to a catch plate 18 as shown in FIG. 3. The distal ends 17 of each of the rear spring elements 14 may comprise engaging tips 38 that are useful for joining the distal ends 17 to mating gripping projections 39 that are spaced along a length of the catch plate 18. The distal ends 17 of the rear spring elements 14 are joined to the catch plate 18 and the catch plate 18 is then foldably engaged with a rear edge 36 of the sub-frame 7 by pushing the catch plate 18 downward (from its natural upward positioned state after molding manufacture) to the rear edge 36 of the sub-frame 7. In particular, there may be engagement grooves 19 spaced along a rear length of the sub-frame 7 into which the distal ends 17 and catch plate 18 fit to change an as molded cartridge into a usable cartridge. With respect to the catch plate 18, it is possible for the catch plate 18 to be formed integrally with the upper frame 6 or not. In the instance where it is not, it is also suitable to form the catch plate 18 from the same material as the upper frame 6 or from a different material that possesses the same or different physical properties than the upper frame material. For instance, a different material may be harder than the rubber or elastomeric material of the spring elements. Suitable materials include, but are not limited to Noryl PX5511® and ABS Cycolac® (both obtained from Saudi Basic Industries Corporation, Selkirk, N.Y.), Delrin® (DuPont), polystyrene, etc.

The rear spring elements 14 lie in respective planes perpendicular to the length of the cartridge 15. The rear spring elements 14, which can also deform by buckling, serve as independent spring-type members acting between the sub-frame 7 and the base 8, and they allow local displacement of the sub-frame 7 towards the base 8, while exerting a substantially constant restoring force resisting such displacement. The resiliently flexible nature of the upper frame 6 and the sub-frame 7 is such that localized portions of the upper frame 6 and the blade 3 incorporated therein may be deflected towards the razor handle 10 in order to adapt to the skin contours. In adapting to the skin contours, the upper frame 6 and the blade 3 may contort to comply with the undulations of the skin area over which they are moving. Therefore, the cartridge 15 is resiliently compliant to ensure close contact with the skin over the full area spanned by the blades.

In the embodiment shown in FIGS. 1-4, several front spring elements 12 comprising flexible webs are distributed along a forward length of the upper face of the cartridge 15. The front spring elements 12 extend between the sub-frame 7 and the base 8 and are integrally formed with the upper face of the cartridge 15. In the embodiment shown, the front spring elements 12 are uniformly spaced apart along the length of the cartridge. The front spring elements 12 typically lie in respective parallel planes perpendicular to the planes of the upper frame 6 and the sub-frame 7. In certain embodiments, the rear spring elements 14 have a depth and/or width that is less than a depth and/or width of the front spring elements.

In the embodiments of FIGS. 1 and 2, the shaving blade 3 occurs in a plurality. That is, there are numerous blades positioned parallel to one another to provide an improved shaving experience. In certain instances of the present invention, the cartridge may comprise at least 3 blades, at least 4 blades, at least 5 blades, at least 7 blades, or at least 8 blades. It should be clear that a larger number of blades may be incorporated into the cartridge of the present invention so long as the overall cartridge dimensions are acceptable and useful for a shaving consumer. To that end, the blade to blade span may be in the range of from about 0.25 mm, 0.5 mm, 0.6 mm, 0.7 mm to about 1.5 mm, 0.85 mm, or 0.8 mm. In the present embodiment, the span is about 0.75 mm.

The shaving blade 3 has a thickness which ranges from about 0.01 mm, 0.02 mm, 0.03 mm, 0.04 mm, 0.05 mm, 0.06 mm, 0.065 mm to about 0.08 mm, 0.075 mm, or 0.07 mm. In this embodiment, the thickness is about 0.66 mm.

The shaving blade 3 also has a width which ranges from about 0.2 mm, 0.3 mm, 0.35 mm to about 0.6 mm, 0.5 mm, and 0.45 mm. In this embodiment, the blade width is about 0.4 mm.

In the embodiment shown in FIGS. 1 and 2, the upper frame 6 further comprises a guard member 22 and a shaving blade 3 (here, a multiplicity of blades 3), the guard member 22 and the blades 3 being formed by flexible strips of metal. Where there is a plurality of blades included in the upper frame 6, they have parallel forwardly facing sharpened cutting edges. The guard member 22 and the blades 3 are interconnected and reinforced by transverse connecting strips 24 used for the manufacture of blade in conventional cartridges, which may be made of the same material as the blades 3, e.g. steel, and which are attached to the undersides of the blades (and any blade supports 13 that may be present) and guard member 22. Maximum flexibility of the cartridge is ensured by the blades 3 and transverse connecting strips 24 being coplanar in the normal, undeformed condition of the blade assembly and the cartridge. In certain embodiments, the shaving blades are mounted on blade supports 13 while the blade supports 13 are joined to a blade frame 1 which is then integrated into the upper frame 6. The shaving blades 3 and/or supports 13 may be folded up from the plane of the blade frame 1 to provide an optimal shaving angle. The shaving angle may range from about 0 to about 35 degrees, from about 5 to about 30 degrees, from about 10 to about 30 degrees, from about 20 to about 30 degrees, from about 22 to about 26 degrees, or about 24 degrees. Another means for configuring blades within a shaving assembly is disclosed in U.S. Pat. No. 6,804,886B2.

In certain embodiments of the present invention, Applicant has found that molding (e.g., injection) an elastomeric and/or rubber material around the shaving blade allows for insertion of the blade without any deleterious stretching of the upper frame and/or sub-frame which may result in a damaged cartridge or an uncomfortably performing shaving cartridge. Any non-shaving portions of the shaving blade are covered by the rubber and/or elastomeric material to heighten comfort. The shaving stresses instead of being concentrated at the anchor points are shared along a much longer piece of steel so it is less likely that the blade will ever pull out.

Moreover, Applicant has determined that incorporating plasticizer into a resin mix that ultimately forms the upper frame and sub-frame aids in the ejection of the cartridge from its mold during manufacture. In certain embodiments, the upper frame and sub-frame material comprises from about 0.1% to about 25%, from 1% to about 20%, from about 5% to about 20%, from about 10% to about 20%, or about 15%, of plasticizer. Typically, elastomeric materials are rather difficult to eject from molds during manufacture. For instance, elastomeric forms like the cartridge of the present invention that are longer in the direction of ejection and narrower across the direction of ejection are particularly hard to eject from molds. In the present invention, the front and rear spring elements are shorter or of reduced depth in comparison to earlier versions of a conforming razor cartridge as disclosed in U.S. Pat. Nos. 7,024,776B2 and 7,131,203B2. In one embodiment, the rear spring elements have a depth that is less than about a depth of the front spring elements. In another embodiment, the rear spring elements have a width that is less than about a width of the front spring elements.

In the embodiment shown, the upper frame 6 comprises a locating hole 33 on one or both sides of the upper frame. The locating hole 33 may have a diameter ranging in size from 0.5 mm to about 4 mm, 1 mm to about 3 mm, or about 2 mm. These holes may be particularly useful during manufacture as they may be used to locate the blades in one or more welding fixtures and the mold. They may also be used to align a plurality of cartridges during safe storage. The location holes 33 may be designed to further comprise a location hole projection (not shown) that protrude from the upper frame 6 during manufacturing that is intended to be cut off toward the end of the manufacturing process to minimize the overall size of the cartridge. Furthermore, although the depicted locating hole is circular, it is envisioned that such a locating hole 33 may be present in a variety of shapes forming an aperture, e.g., rectangular, triangular, elliptical, square, wavy, slitted, and even combinations thereof.

The guard member 22 spans the length of the cartridge 15 and may comprise a plurality of ribs 23 that work together to provide a skin stretching benefit to a shaver prior to blade engagement of a shaver's hair.

A cap 25 of the upper frame 6 may be instrumental in determining the shaving geometry of a wet shaving razor. This typically comes into relevance in the case where a plurality of blades 3 is included in the cartridge. For reference, shaving geometry is understood to include a measurement of the "exposure" of a rearwardmost blade edge nearest a cap, as known from the prior art, e.g., as disclosed in U.S. Pat. No. 6,212,777. In some instances, the exposure of the rearward blade is determined relative to a substantially fixed, rigid portion of the cartridge 15. In the present instance, where the cap 25 is a portion of the upper frame which in turn comprises resiliently flexible material it is presumed that the cap 25 need not be substantially fixed or rigid in comparison to the remainder of the cartridge in order to obtain the measurement. The cap 25 of the cartridge 15 may include shaving aid member 26 which sits on a front edge or adjacent a rear edge of the upper frame 6. As shown in FIGS. 1 and 2, where a shaving aid member is present and there is a plurality of blades 3, the exposure of a rearward blade may be determined relative to a shaving aid member surface that is disposed on or near the cap 25.

Suitable shaving aid members 26 may be selected from the group consisting of lubrication strips, indicator strips, soap wings, shave gel bars, and combinations thereof. Such shaving aid members are disclosed in U.S. Pat. Nos. 5,956,848, 5,998,431, 5,906,834, 6,185,822, 6,298,559, 6,301,785, 6,442,839, 6,944,952, 7,069,658; and US Patent Publications US 2006/0143925 A1, 2006/0080838 A1, and 2007/0110703 A1.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A wet shaving razor comprising a cartridge having a length wherein said cartridge comprises:

a) an upper frame comprising
   1) a blade frame;
   2) a shaving blade joined to said blade frame where said blade extends lengthwise along said cartridge;
   3) an upper face that surrounds said blade frame; and
   4) one or more serially arranged rear spring elements, each element having a proximate and distal end such that said proximate end is joined adjacent a top edge of said upper face;

b) a sub-frame upon which said upper frame is resiliently mounted at its bottom edge near a front edge of said sub-frame wherein said sub-frame further comprises front spring elements; and c) a catch plate joined to said distal ends, said catch plate causes said rear spring elements to foldably engage with a rear edge of said sub-frame to provide removably secured rear spring elements; and wherein said front spring elements and rear spring elements oppose local deformation of the cartridge under shaving forces encountered during shaving.

2. The wet shaving razor of claim 1 wherein said shaving blade is reinforced by at least one transverse connecting strip.

3. The wet shaving razor of claim 1 wherein said distal end further comprises an engaging tip.

4. The wet shaving razor of claim 3 wherein said engaging tip engages with a gripping projection of said catch plate.

5. The wet shaving razor of claim 1 wherein said rear spring elements have a depth that is less than about a depth of the front spring elements.

6. The wet shaving razor of claim 1 wherein said rear spring elements have a width that is less than about a width of the front spring elements.

7. The wet shaving razor of claim 1 wherein said rear spring elements are hingedly joined to said top edge of said upper face.

8. The wet shaving razor of claim 1 wherein said upper frame and said sub-frame are integrally molded.

9. The wet shaving razor of claim 1 wherein said catch plate is integrally molded with said rear spring elements.

10. The wet shaving razor of claim 1 wherein said catch plate is formed from a different material than said upper frame.

11. The wet shaving razor of claim 1 wherein said cartridge further comprises a base upon which said sub-frame is mounted.

12. The wet shaving razor of claim 1 wherein said shaving blade comprises at least three shaving blades.

13. The wet shaving razor of claim 1 wherein said upper face further comprises a shaving aid strip that spans at least a portion of a length of said upper face.

14. The wet shaving razor of claim 13 wherein said shaving aid strip comprises a plurality of portions that are spaced along the length of said upper face.

15. The wet shaving razor of claim 1 wherein said upper frame comprises a locating hole.

* * * * *